US010800995B1

(12) United States Patent
Sahley et al.

(10) Patent No.: US 10,800,995 B1
(45) Date of Patent: Oct. 13, 2020

(54) AUTOMOTIVE FINISH PROTECTION FORMULATION

(71) Applicants: Joshua Sahley, New York, NY (US); Krzysztof Zając, Cracow (PL)

(72) Inventors: Joshua Sahley, New York, NY (US); Krzysztof Zając, Cracow (PL)

( * ) Notice: Subject to any disclaimer, the term of this patent is extended or adjusted under 35 U.S.C. 154(b) by 0 days.

(21) Appl. No.: 16/124,090

(22) Filed: Sep. 6, 2018

Related U.S. Application Data

(60) Provisional application No. 62/554,935, filed on Sep. 6, 2017.

(51) Int. Cl.

| | |
|---|---|
| ***C11D 1/90*** | (2006.01) |
| ***C11D 3/10*** | (2006.01) |
| ***C11D 3/22*** | (2006.01) |
| ***C11D 11/00*** | (2006.01) |
| ***C11D 1/66*** | (2006.01) |
| ***C11D 17/04*** | (2006.01) |
| ***C11D 3/20*** | (2006.01) |
| *C11D 1/825* | (2006.01) |

(52) U.S. Cl.
CPC ..... *C11D 1/662* (2013.01); *C11D 3/10* (2013.01); *C11D 3/2086* (2013.01); *C11D 11/0023* (2013.01); *C11D 17/049* (2013.01); *C11D 1/825* (2013.01)

(58) Field of Classification Search
CPC .. C11D 1/662; C11D 1/90; C11D 3/10; C11D 3/2065; C11D 3/2093; C11D 3/22; C11D 11/00; C11D 17/049
See application file for complete search history.

(56) References Cited

U.S. PATENT DOCUMENTS

2014/0199416 A1* 7/2014 Gaudreault ..... C11D 3/2068 424/717
2018/0142185 A1* 5/2018 Gaudreault ..... C11D 1/04

* cited by examiner

*Primary Examiner* — Brian P Mruk
(74) *Attorney, Agent, or Firm* — White-Welker & Welker, LLC; Matthew T. Welker, Esq.

(57) ABSTRACT

Potassium carbonate, Cocoglucoside, a Preservative, Sodium gluconate, and Demineralized water. The formulation is intended to be dispensed and/or applied from a spray bottle or wet wipe. Demineralized water is used as a solvent and has a concentration of approximately up to approximately 99 percent of the weight by percentage. Potassium carbonate is the uric acid remover, and has a concentration of approximately 1-25 percent of the formulation. Cocoglucoside or Coco Glucoside is a natural, non-ionic, surfactant and acts as a cleaner and has a concentration of approximately 0.1-15 percent. Sodium gluconate is used as a chelating agent and has a concentration of approximately 0.1-25 percent. A chemical preservative may be added the formulation in any amount or percentage as desired or in any amount or sufficient quantity desired for the preservation or shelf life of the product.

12 Claims, 3 Drawing Sheets

MAIN FORMULA WITH ADDITIONAL NATURAL CLEANER

| Compound | Role | Concentration [%] |
|---|---|---|
| Potassium carbonate | Uric acid remover | 1 - 15% |
| Cocoglucoside | Cleaner | 0.1 - 15% |
| Decyl Glucoside | Cleaner | 0.1 - 15% |
| Preservative | | qs |
| Sodium gluconate | Chelating agent | 0.1 - 15% |
| Demineralized water | Solvent | up to 100% |

MAIN BIRD DROPPING CLEANER

| Compound | Role | Concentration [%] |
|---|---|---|
| Potassium carbonate | Uric acid remover | 1 - 15% |
| Cocoglucoside | Cleaner | 0.1 - 20% |
| Preservative | | qs |
| Sodium gluconate | Chelating agent | 0.1 - 15% |
| Demineralized water | Solvent | up to 100% |

Fig. 1

MAIN FORMULA WITH ADDITIONAL NATURAL CLEANER

| Compound | Role | Concentration [%] |
|---|---|---|
| Potassium carbonate | Uric acid remover | 1 - 15% |
| Cocoglucoside | Cleaner | 0.1 - 15% |
| Decyl Glucoside | Cleaner | 0.1 - 15% |
| Preservative | | qs |
| Sodium gluconate | Chelating agent | 0.1 - 15% |
| Demineralized water | Solvent | up to 100% |

Fig. 2

MAIN FORMULA WITH ADDITIONAL CLEANER

| Compound | Role | Concentration [%] |
|---|---|---|
| Potassium carbonate | Uric acid remover | 1 - 15% |
| Cocobetaine | Cleaner | 0.1 - 15% |
| Decyl Glucoside | Cleaner | 0.1 - 15% |
| Preservative | | qs |
| Sodium gluconate | Chelating agent | 0.1 - 15% |
| Demineralized water | Solvent | up to 100% |

Fig. 3

AUTOMOTIVE FINISH PROTECTION FORMULATION

CROSS REFERENCE TO RELATED APPLICATIONS

This application claims priority from U.S. Patent Application Ser. No. 62/554,935, entitled "Automotive Finish Protection Formulation", filed on Sep. 6, 2017. The benefit under 35 USC § 119(e) of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates in general to automotive finishes. More specifically, the present invention relates to an automotive finish formulation for specifically neutralizing bird dropping and other acidic environmental hazards.

BACKGROUND OF THE INVENTION

Bird drippings can be extremely damaging to a car's paint job. If left untreated, bird droppings can penetrate a car's clear coat protective layer. Bird droppings have acid and can burn through the clear coat as quick as two days. Waiting too long to remove bird droppings can burn the clear coat and paint surface all the way to the metal.

Damage from bird droppings increases when it's hot outside because the droppings can warm up and harden on the paint. The sight of a car's clear coat protective layer being etched by bird droppings is not only the result of the corrosive property of the dropping. Damage also results from the car's clear coat protective layer contracting upon cooling to the uneven texture of the hardened deposit.

As paint lacquer warms during the day, it softens and expands. At the same time, that heat dries and hardens any bird droppings on the surface, as the paint lacquer cools overnight, it contracts, hardens around the texture of the bird dropping.

Bugs, meanwhile, interact in a similar way with paint. They also have chemicals that can eat through the clear coat and cause damage. Bugs can collect by the dozens on cars, especially during long highway trips.

The clear coat will eventually start to lift at different points where the clear coat has been damaged. Once the clear coat starts lifting, there's really no way to stop it.

Wax and polish treatments that protect against chemical attack from acid rain and UV sun damage provide limited protection from the paint expanding and contracting around bird droppings and the chemical interaction between the dropping and the car's clear coat, although they will make them easier to remove.

While it is recommended to wash a car once a week to remove droppings and bugs; this is often impractical for many car owners. Therefore it is recommended to keep a bottle of water and a microfiber rag in the car to quickly wipe away animal waste and other debris.

While water moistens a bird dropping and makes it easier to remove and may eliminate the damage from the physical heating and cooling of the dropping, water does nothing to neutralize the chemical effects associated with bird droppings or bugs.

Therefore, what is needed is a formulation or solution to replace the water commonly used on such wipes with a formulation that will neutralized the chemicals in bird droppings and bugs to stop or eliminate chemical interactions between droppings, bugs, and a car's clear coat.

Definitions

"Bases" are substances that, in aqueous solution, are slippery to the touch, taste astringent, change the color of indicators (e.g., turn red litmus paper blue), react with acids to form salts, promote certain chemical reactions (base catalysis), accept protons from any proton donor, and/or contain completely or partially displaceable OH— ions. Examples of bases are the hydroxides of the alkali metals and alkaline earth metals (NaOH, Ca(OH)2, etc.). Bases can be thought of as the chemical opposite of acids. Bases and acids are seen as opposites because the effect of an acid is to increase the hydronium (H3O+) concentration in water, whereas bases reduce this concentration. The notion of a base as a concept in chemistry was first introduced by the French chemist Guillaume François Rouelle in 1754. He noted that acids, which at that time were mostly volatile liquids (like acetic acid), turned into solid salts only when combined with specific substances. Rouelle considered that such a substance serves as a "base" for the salt, giving the salt a "concrete or solid form".

"Chelation" is a type of bonding of ions and molecules to metal ions. It involves the formation or presence of two or more separate coordinate bonds between a polydentate (multiple bonded) ligand and a single central atom. Usually these ligands are organic compounds, and are called chelates, chelators, chelating agents, or sequestering agents.

A "Chelating Agent" is a substance which combines with a metallic ion to produce an inert chelate.

"Hydroxide" is a diatomic anion with chemical formula OH—. It consists of an oxygen and hydrogen atom held together by a covalent bond, and carries a negative electric charge. It is an important but usually minor constituent of water. It functions as a base, a ligand, a nucleophile and a catalyst. The hydroxide ion forms salts, some of which dissociate in aqueous solution, liberating solvated hydroxide ions. A hydroxide attached to a strongly electropositive center may itself ionize, liberating a hydrogen cation (H+), making the parent compound an acid. Many inorganic substances which bear the word "hydroxide" in their names are not ionic compounds of the hydroxide ion, but covalent compounds which contain hydroxyl groups.

"Neutralization" is a reaction between an acid and base. In a neutralization reaction, an aqueous solution of a base reacts with an aqueous solution of an acid to produce a solution of water and salt in which the salt separates into its component ions. If the aqueous solution is saturated with a given salt solute, any additional such salt precipitates out of the solution.

SUMMARY OF THE INVENTION

The present invention is an automotive finish protection formulation. The formulation is comprised of the following compounds: Potassium carbonate, Cocoglucoside, a Preservative, Sodium gluconate, and Demineralized water. The formulation of the present invention is intended to be dispensed and/or applied from a spray bottle or wet wipe.

Demineralized water is used as a solvent and has a concentration of approximately up to approximately 99 percent of the weight by percentage. Potassium carbonate is the uric acid remover, and has a concentration of approximately 1-25 percent of the formulation. Cocoglucoside or Coco Glucoside is a natural, non-ionic, surfactant and acts as a cleaner and has a concentration of approximately 0.1-15 percent. Sodium gluconate is used as a chelating agent and has a concentration of approximately 0.1-25 percent.

A chemical preservative may be added the formulation in any amount or percentage as desired or in any amount or sufficient quantity desired for the preservation or shelf life of the product.

In an alternative embodiment Decyl Glucoside, and additional can be added to the formulation in the same percentage as the Cocoglucoside cleaner, 0.1-15 percent. In yet another alternative embodiment, Cocoglucosiden can be substituted with Cocobetaine in the same percentage of 0.1-15 percent.

BRIEF DESCRIPTION OF THE DRAWINGS

The accompanying drawings, which are incorporated herein and form a part of the specification, illustrate the present invention and, together with the description, further explain the principles of the invention and to enable a person skilled in the pertinent art to make and use the invention.

FIG. 1 is a table that illustrates the formulation of the present invention.

FIG. 2 is a table that illustrates an alternative embodiment formulation containing an additional natural cleaner of the present invention.

FIG. 3 is a table that illustrates an alternative embodiment formulation containing an additional natural cleaner of the present invention.

DETAILED DESCRIPTION OF THE INVENTION

Figure 4:
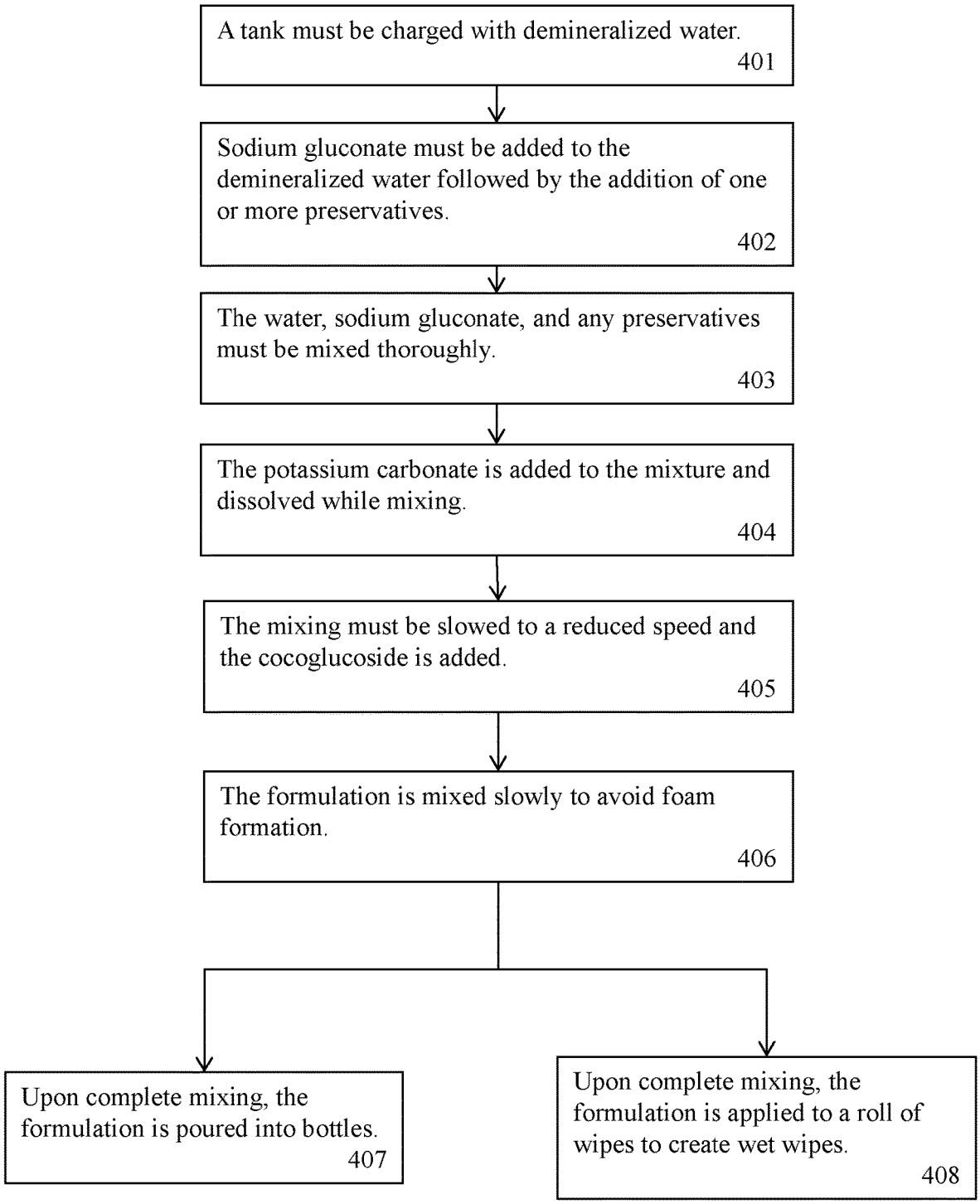
FIG. 4 is a flow chart that illustrations the manufacturing process of the formulation of the present invention.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figure, it is possible to see the various major elements constituting the apparatus of the present invention.

The present invention is a formulation for the protection of an automobile or other vehicle or painted surface from bird droppings and other environmental hazards that can have a chemical interaction with a clear coat protective paint layer.

The most common application of the present invention is to cars and other transportation vehicles, which are commonly painted using a base coat/clear coat painting process, where the clear coat is susceptible to chemical interaction with acidic compounds, such as bird droppings and bug remains, resulting in damage to the finish.

Bird droppings are composed out of several main ingredients: uric acid, various organic compounds, water, and a variety of inorganic compounds (salts).

Inorganic compounds, such as salts, can be dissolved and removed by water. This action is empowered by the presence of chelating agent which improves the dissolution of hard or dried dropping to dissolve the salts.

Uric acid itself is only slightly soluble in water or organic solvents. It can be only removed when reacted with a base, converted to a salt, and dissolved.

A study completed by the inventor(s) has shown, unexpectantly, that out of the most popular bases, those which have a larger counter-ion give more soluble salts. Therefore, when considering lithium carbonate, sodium carbonate, and potassium carbonate, the Inventor has found, unexpectantly, that potassium carbonate gives potassium urate, the salt with the highest solubility.

Hydroxides, which can give faster resolution than carbonates, and which might be an obvious or expected solution to the problem solved by the formulation of the present invention, were ruled out due to the fact that hydroxides solutions tend to be corrosive, which would result in damage to a car's clear coat, completely negating the purpose of the present invention in a wipe embodiment.

The remaining organic compounds can be removed either by solvents or surfactants. In the formulation of the present invention, a small amount of organic surfactant was, unexpectantly, found to remove even old and dried bird droppings, which was demonstrated during the tests. The formula of the present invention neutralizes the acid and destabilizes the dropping or marking, making it easy to clean up immediately with one of the surfactants.

Now referring to FIG. 1, a table illustrations the formulation and concentration of each of the compounds in the formulation of the present invention. The formulation is comprised of the following compounds: Potassium carbonate, Cocoglucoside, a Preservative, Sodium gluconate, and Demineralized water.

In a preferred embodiment, Potassium carbonate is the uric acid remover, and has a concentration of approximately 1-15 percent of the formulation but he percentage can be as high as 25 percent in alternative embodiments.

Cocoglucoside or Coco Glucoside is a natural, non-ionic, surfactant. Like Decyl Glucoside, Cocoglucoside or Coco Glucoside is ultra-mild, and one of the most gentle of the cleansing agents, making it ideal for all foaming and cleansing products. Cocoglucoside, in the formulation of the present invention acts a cleaner and has a concentration of approximately 0.1-20 percent.

A Preservative is a substance or a chemical that is added to products such as food, beverages, pharmaceutical drugs, paints, biological samples, cosmetics, wood, and many other products to prevent decomposition by microbial growth or by undesirable chemical changes. In general, preservation is implemented in two modes, chemical and physical. Chemical preservation entails adding chemical compounds to the product. Physical preservation is not necessary for the formulation of the present invention during manufacturing or to increase or enhance shelf-life of the final product.

A chemical preservative may be added the formulation in any amount or percentage as desired or in any amount or sufficient quantity desired for the preservation or shelf life of the product. The typical amount is 0.01-1 percent. Nothing in the formulation is a subject of visible degradation, so the addition of a preservative to the formulation and any formulation using a preservative is an alternative embodiment to the base formulation, and varying percentages of preservatives and varying preservative compounds are also potential alternative embodiments of the formulation of the present invention.

Sodium gluconate is a compound with formula $NaC_6H_{11}O_7$. It is the sodium salt of gluconic acid. Sodium gluconate is widely used in textile dyeing, printing, and metal surface water treatment. It is also used as a chelating agent, a steel surface cleaning agent, a cleaning agent for glass bottles, and as a chelating agent for cement, plating, and alumina dyeing industries. It is a white powder that is very soluble in water. In the formulation of the present invention Sodium gluconate is used as a chelating agent and has a concentration of approximately 0.1-15 percent in a preferred embodiment, but can be as high as 25 in alternative embodiments.

Deionized water (DI water, DIW or de-ionized water), often synonymous with demineralized water/DM water, is water that has had almost all of its mineral ions removed, such as cations like sodium, calcium, iron, and copper, and anions such as chloride and sulfate. Deionization is a chemical process that uses specially manufactured ion-exchange resins, which exchange hydrogen and hydroxide ions for dissolved minerals, and then recombine to form water. Because most non-particulate water impurities are dissolved salts, deionization produces highly pure water that is generally similar to distilled water, with the advantage that the process is quicker and does not build up scale. In the formulation of the present invention Demineralized water is used as a solvent and has a concentration of approximately up to 100 percent, with a typical range being 0.1 to 99.7 percent by weight of the formulation.

Additional benefits of the formulation of the present invention are that it is solvent free since it uses Cocoglucoside, a natural, mild, non-ionic, surfactant, instead of a harsh solvent. The formula neutralizes the acid and destabilizes the dropping or marking, making it easy to clean up immediately with one of the surfactants. In the present invention, the Inventors have disclosed and teach the use of specific surfactants, and are continuing experiments to investigate additional surfactants or combinations and percentages of the compounds which may yield additional, unexpected, better results in neutralization, destabilization, and cleaning.

Additionally, the use of tap water could precipitate insoluble magnesium and calcium carbonates, but the formulation of the present invention specifically requires the use of demineralized water, removing the potential for the creating of such harmful and undesired compounds to form upon application of the formula with bird droppings or other environmental hazards.

Finally, the formulation of the present invention can be certified as organic, due to the specific combination of compounds used.

Now referring to FIG. 2, an alternative embodiment of the present invention is illustrated. In this embodiment, Decyl Glucoside is used in combination with Cocoglucoside, both being cleaners as previously discussed. In this embodiment, the two cleaners can be present in any range of 0.1-15 percent by weight, individually. This alternative embodiment provides an additional cleaning compound and provides additional and alternative chemical reactions for neutralizing bird droppings.

Now referring to FIG. 3, an alternative embodiment of the present invention is illustrated. In this embodiment, Decyl Glucoside is used in combination with Cocobetaine, both being cleaners as previously discussed. In this embodiment, the two cleaners can be present in any range of 0.1-15 percent by weight, individually. This alternative embodiment provides a different combination of cleaners, while providing an additional cleaning compound compared to the main formulation. This embodiment also provides alternative chemical reactions for neutralizing bird droppings compared to the main formulation.

Now referring to FIG. 4, the manufacturing process of the present invention is described in detail. First, a tank must be charged with demineralized water 401. Next sodium gluconate must be added to the demineralized water followed by the addition of one or more preservatives 402. The water, sodium gluconate, and any preservatives must be mixed thoroughly 403. Next, the potassium carbonate is added to the mixture and dissolved while mixing 404. Next the mixing must be slowed to a reduced speed and the cocoglucoside is added 405. Finally, the formulation is mixed slowly to avoid foam formation. 406. Upon complete mixing, the formulation is poured into bottles 407 or the formulation is applied to a roll of wipes to create wet wipes 408.

The product can be delivered to end users or consumers in two formats. The first format is a spray bottle for dispensing the formulation on a surface and then being wiped off with a paper towel, microfiber cloth, or any other fabric. The second formation is for the formulation to be dispensed into wipes, which can be pulled and released in sections. The wipes are soaked with the formulation and can then be applied directly to any surface which his desired to be cleaned or coated.

When the formulation is applied, the potassium carbonate is neutralizing uric acid from bird droppings or other environmental hazards by creating a urate, a soluble salt of uric acid. In this form it is no longer acidic. In chemistry, this reaction is called neutralization.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. An automotive finish protection formulation, the chemical composition comprising:

from about 1 to about 25 by weight percentage potassium carbonate;

from about 0.01 to about 15 by weight percentage of Decyl Glucoside;

from about 0.1 to about 15 by weight percentage cocoglucoside;

from about 0.1 to about 25 by weight percentage sodium gluconate; and from about 0.1 to about 99.7 by weight percentage demineralized water.

2. The composition of claim 1, in combination with a spray bottle for application.

3. The composition of claim 1, in combination with a roll of wipes for dispensing and application.

4. The composition of claim 1, further comprising from about 0.01 to about 1.0 by weight percentage of a Preservative.

5. The composition of claim 4, in combination with a spray bottle for application.

6. The composition of claim 4, in combination with a roll of wipes for dispensing and application.

7. An automotive finish protection formulation, the chemical composition comprising:

from about 1 to about 25 by weight percentage potassium carbonate;

from about 0.1 to about 15 by weight percentage cocobetaine;

from about 0.1 to about 15 by weight percentage decyl glucoside;

from about 0.1 to about 25 by weight percentage sodium gluconate; and from about 0.1 to about 99.7 by weight percentage demineralized water.

8. The composition of claim 7, in combination with a spray bottle for application.

9. The composition of claim 7, in combination with a roll of wipes for dispensing and application.

10. The composition of claim 7, further comprising from about 0.01 to about 1.0 by weight percentage of a Preservative.

11. The composition of claim 10, in combination with a spray bottle for application.

12. The composition of claim 10, in combination with a roll of wipes for dispensing and application.

* * * * *